United States Patent [19]

Klittich

[11] Patent Number: 4,533,057

[45] Date of Patent: Aug. 6, 1985

[54] FEEDING BOTTLE WITH TUBULAR HOUSING FOR CLAMPING FLEXIBLE CONTAINER

[76] Inventor: Klaus Klittich, P.O. Box 501, Germiston 1400, South Africa

[21] Appl. No.: 359,088

[22] Filed: Mar. 17, 1982

[30] Foreign Application Priority Data

Mar. 31, 1981 [ZA] South Africa ..... 81/2145
May 4, 1981 [ZA] South Africa ..... 81/2939

[51] Int. Cl.[3] ..... A61J 9/00
[52] U.S. Cl. ..... 215/11 E
[58] Field of Search ..... 215/11 E, 11 R

[56] References Cited

U.S. PATENT DOCUMENTS

| | | | |
|---|---|---|---|
| 2,604,222 | 7/1952 | Teague et al. | 215/11 E |
| 2,624,485 | 1/1953 | Boston | 215/11 E |
| 2,859,891 | 11/1958 | Carkin | 215/11 E |
| 2,881,935 | 4/1959 | Garred | 215/11 E |
| 2,885,104 | 5/1959 | Greenspan | 215/11 R X |
| 3,061,129 | 10/1962 | Fitzgerald | D24/48 X |
| 3,075,666 | 1/1963 | Hoffstein | 215/11 E |
| 3,134,494 | 5/1964 | Quinn | 215/11 E |
| 3,204,855 | 9/1965 | Boynton et al. | 215/11 E X |
| 3,471,050 | 10/1969 | Barr | 215/11 E |
| 3,645,414 | 2/1972 | Barr | 215/11 R |
| 3,790,017 | 2/1974 | Fitzpatrick et al. | 215/11 E |
| 3,998,348 | 12/1976 | Sammaritano | 215/11 E X |
| 4,339,046 | 7/1982 | Coen | 215/11 E X |

FOREIGN PATENT DOCUMENTS

| | | | |
|---|---|---|---|
| 1928945 | 12/1970 | Fed. Rep. of Germany . | |
| 2557540 | 6/1977 | Fed. Rep. of Germany . | |
| 1215335 | 4/1960 | France . | |
| 1287487 | 2/1962 | France . | |
| 2232300 | 1/1975 | France | 215/11 E |
| 2434759 | 3/1980 | France . | |
| 71844 | 1/1975 | Luxembourg . | |
| 602103 | 7/1978 | Switzerland . | |

*Primary Examiner*—William Price
*Assistant Examiner*—Sue A. Weaver
*Attorney, Agent, or Firm*—Finnegan, Henderson, Farabow, Garrett, & Dunner

[57] ABSTRACT

A housing for a baby feeding bottle which comprises a tubular housing with an open upper end; a disposable, open-ended, flexible bag-like container locatable in the interior of the housing with a mouth zone of the container folded over the upper end of the housing; and a teat or nipple which is locatable over the mouth of the container and the upper zone of the housing. The tubular housing is longitudinally divided into two halves which are movable between open and closed positions to facilitate loading of a container into the housing. The housing may also have anchoring means located at low level in the housing and adapted to anchor the base of a container and fix the extent of the mouth zone of the container available for folding over the upper end of the housing to permit reliable scaling of the contents of the container.

8 Claims, 11 Drawing Figures

Fig 8.
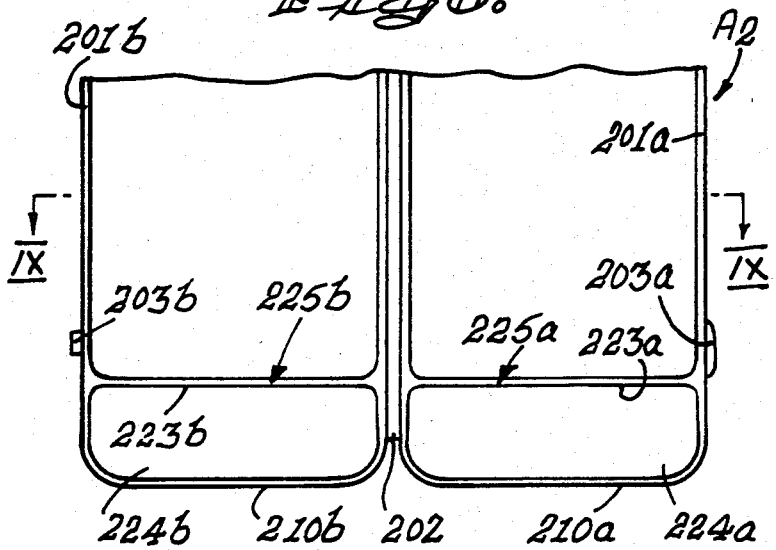
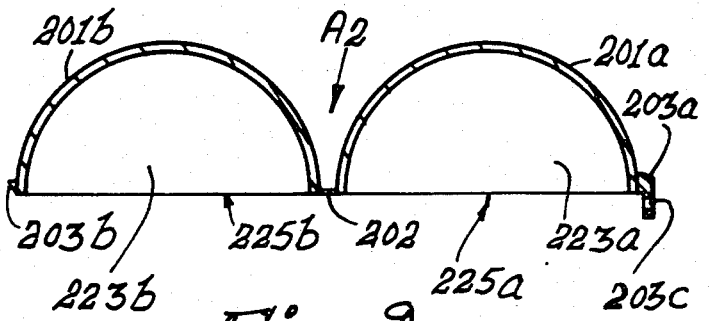
Fig 9.

Fig 10.
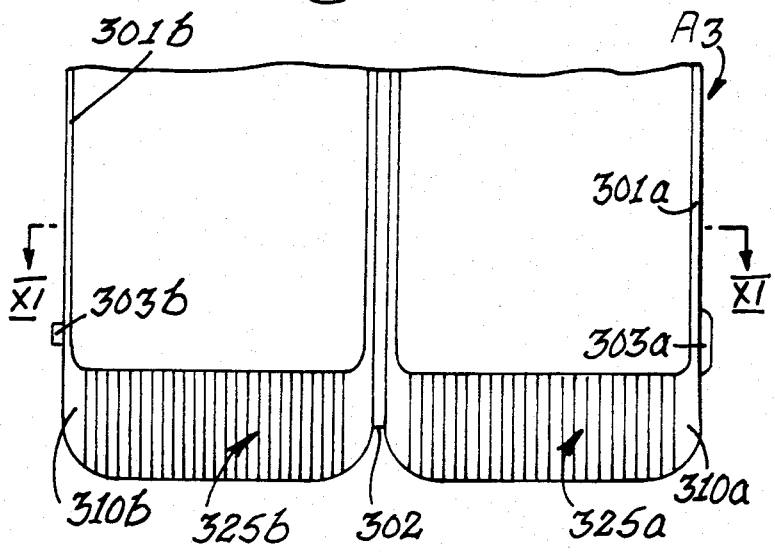
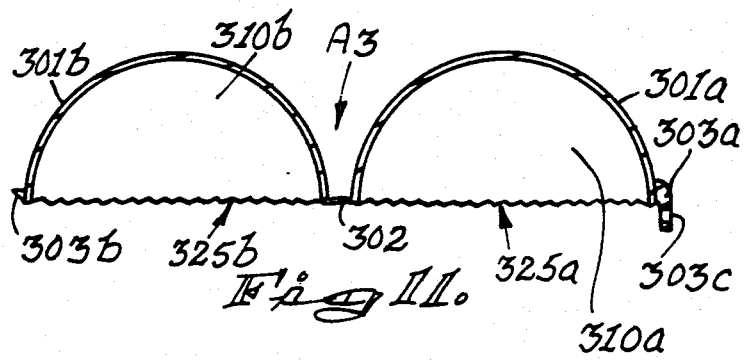
Fig 11.

FEEDING BOTTLE WITH TUBULAR HOUSING FOR CLAMPING FLEXIBLE CONTAINER

This invention relates to feeding bottles for babies.

It is known to provide a feeding bottle of the kind comprising a tube, usually of suitable synthetic resinous material, which acts as a protective housing for holding a disposable flexible bag-type container for liquids. The container is suspended in the interior of the tube with its mouth zone folded over the open top of the tube and the container may be sealingly locked in position by means of a resiliently flexible teat or nipple which engages over the mouth of the container and the top zone of the tube. When the bottle is to be used the container is filled with liquid, usually after the container has been properly suspended in the tube, whereafter the teat is placed in position over the top of the tube.

A graduated contents scale, usually located along the outside of the tube body, is normally provided to give an indication of the amount of liquid in the container. Normally disposable containers are provided in presterilized condition and are discarded after a single use.

A further feature of some embodiments of the feeding bottle is a cap which is adapted to clip over the teat for reasons of hygiene and/or for sealing the teat when the bottle is not in use. When the bottle is in use, the cap may be plugged into the base of the tube to serve as a support platform and/or as a bottom closure for the tube. Often a special locking ring is provided for location around a skirt portion of the teat which engages over the tube top.

Feeding bottles of the kind referred to above are disclosed, for example, in U.S. Pat. Nos. 3 075 666, 3 204 855 and 3 790 017.

The bottle arrangement in question suffers from the disadvantage that it is not always an easy task properly to load a flexible container into the tube through an open end thereof. Furthermore, the container suspended in the tube depends a distance below the tube top which varies according to the extent to which the bag mouth is folded over the tube top. Accordingly a contents scale on the tube body can scarcely provide any reliable accuracy as to the contents of the container within the tube.

The above mentioned U.S. patents disclose the use of an assembly tool to ensure uniform positioning of the container in the tube to permit exact scaling of the contents of the container. This has the disadvantage that it requires a separate tool which complicates the use of the bottle. U.S. Pat. Nos. 3 204 855 and 3 790 017 also disclose the use of liquid-retaining bags or sacs designed for manual positioning without the use of an assembly tool, which include special tabs extending from the mouth zones of the sacs. It has been found that in practice the proper and consistent positioning of such bags or sacs is not always easy.

It is an object of the present invention to avoid or at least to minimize the above disadvantages.

According to the invention a feeding bottle housing which is of tubular configuration with an open upper end adapted to receive a teat and which is adapted to accommodate an open-ended flexible container in the interior of the housing with a mouth zone of the container folded over the upper end of the housing, is characterized in that the housing is longitudinally divided into two sections which are movable between open and closed positions.

Preferably, the housing is longitudinally divided into two sections which are linked along a longitudinally extending hinge zone and are movable about the hinge zone between open and closed positions.

The tubular housing of the invention constitutes a holder adapted to mount a flexible container and also to mount a teat to provide a feeding bottle. Loading of a flexible container into the housing is facilitated by the feature that the housing may be opened about the longitudinal hinge zone.

The two housing sections may be adapted to be releasably locked together in the closed position.

According to a further feature of the invention, anchoring means may be located at low level in the housing and adapted to anchor the base of a flexible container to fix the extent of the mouth zone of the container available for folding over the upper end of the housing.

With the arrangement of the previous paragraph the fold of disposable flexible containers over the upper end of the tubular housing may be relatively uniform from container to container so that the length of the container depending below the upper end of the housing may be relatively uniform from container to container, whereby a relatively reliable indication of the contents of a container suspended in the tubular housing may be obtained.

The anchoring means may comprise clamping means.

The clamping means may be adapted to be inoperative when the two housing sections are in an open position and to engage a base region of the container when the two housing sections are in their closed position.

Preferably, the base region of the container which is engaged by the clamping means comprises a tongue or other suitable base formation depending from the container body so that the actual body of the container is not engaged by the clamping means.

The clamping means may comprise co-operating clamp formations on the two housing sections presenting mating surfaces adapted to nip the base region of the container when the two sections are in their closed position.

The mating surfaces may include gripping formations to enhance their engagement with the base region of the container.

In one embodiment of the invention the clamp formations are of tongue and groove form.

The mating surfaces of the clamp formations may be of complementary semi-circular cross-sectional configuration.

The mating surfaces of such clamp formations may be screw threaded to enhance their engagement with the base region of the container.

The tongue and groove clamp formations may extend axially from a transverse floor in the base region of the housing.

In another embodiment of the invention the clamp formations present mating surfaces extending substantially diametrically across the two housing sections. Such mating surfaces may be substantially plane or may include serrations or any other suitable gripping formations to enhance their engagement with the base region of the container.

For a clear understanding of the invention preferred embodiments will now be described by way of example with reference to the accompanying drawings in which:

FIG. 8 is a fragmentary elevational view of the lower region of a further embodiment of a tubular housing according to the invention in open position, illustrating one form of clamp formations with mating surfaces extending diametrically across the halves of the housing.

FIG. 9 is a cross-section on the line IX—IX in FIG. 8.

FIG. 10 is a fragmentary elevational view of the lower region of yet another embodiment of a tubular housing according to the invention, illustrating another form of clamp formations with mating surfaces extending diametrically across the halves of the tubular housing.

FIG. 11 is a cross-section on the line XI—XI in FIG. 10.

Figure 1:
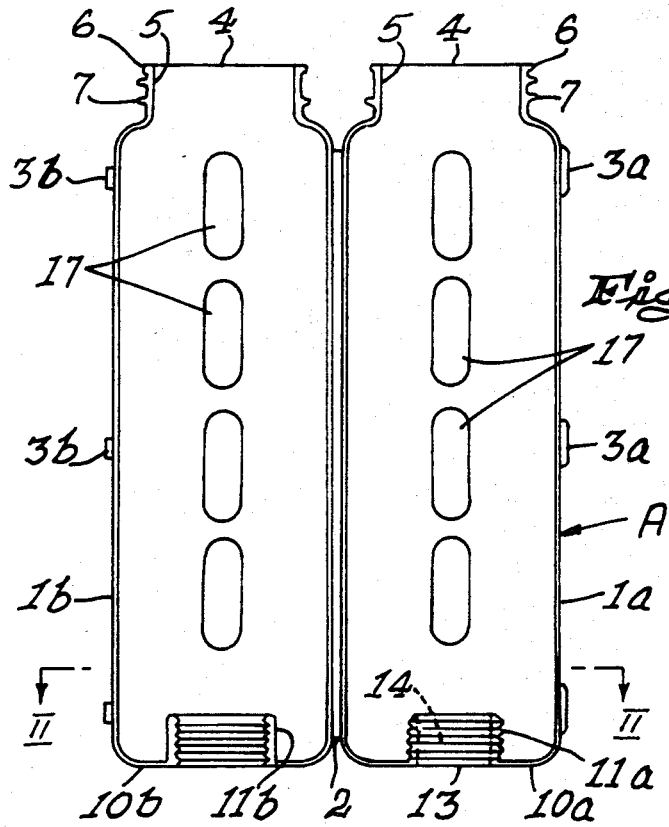
FIG. 1 is an elevational view of one embodiment of a tubular feeding bottle housing according to the invention in open position, illustrating one form of complementary tongue and groove clamp formations.
Figure 2:
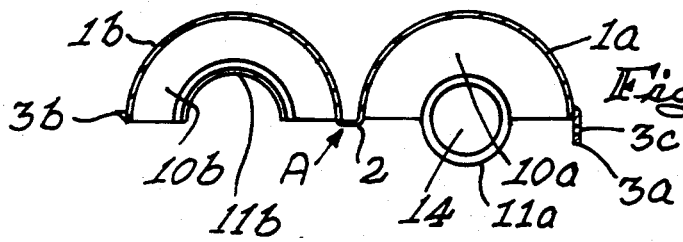
FIG. 2 is a section on the line II—II in FIG. 1.
Figure 3:
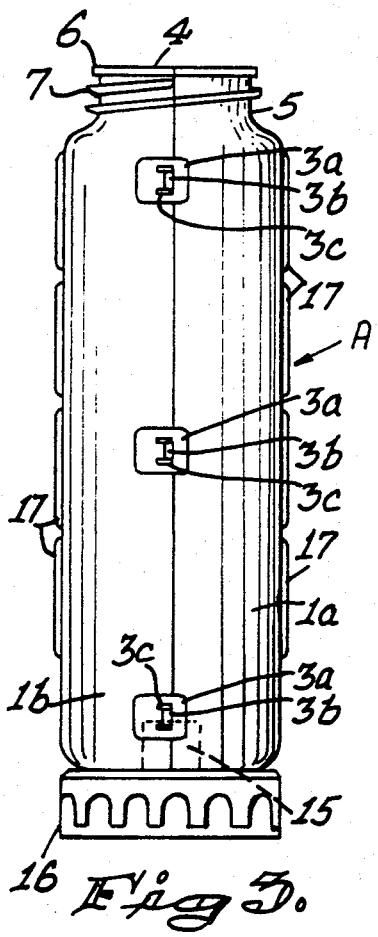
FIG. 3 is an elevational view of the tubular housing of FIGS. 1 and 2 in closed position, showing a cap plugged into the base of the housing.
Figure 4:
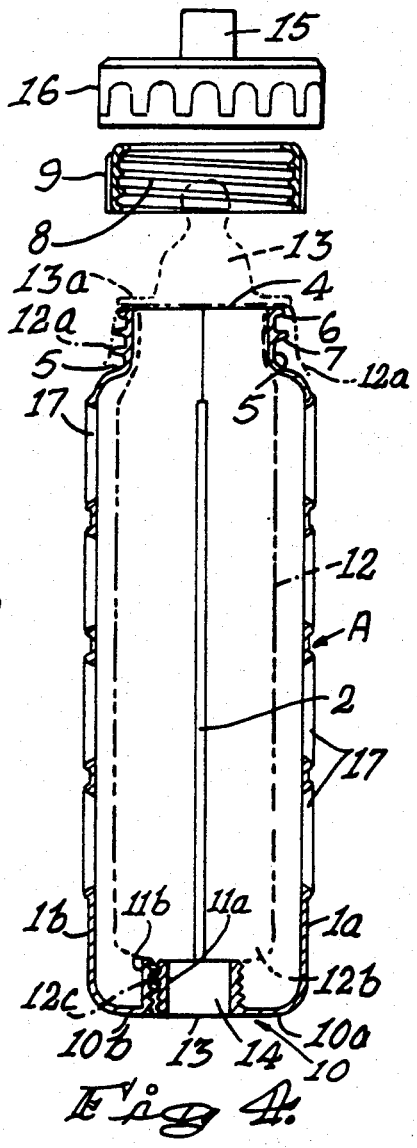
FIG. 4 is a sectional elevation of the closed housing, showing certain associated parts in exploded positions.
Figure 5:
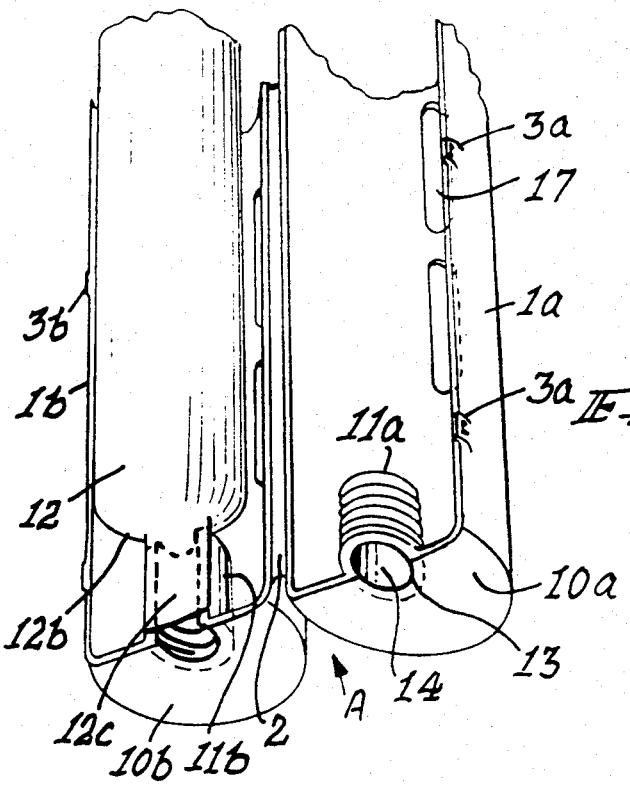
FIG. 5 is a fragmentary perspective view of the lower region of the tubular housing of FIGS. 1 to 4 in open position, showing a disposable, flexible bag-like container in position in one section of the housing.

Referring first to FIGS. 1 to 5, a feeding bottle unit includes tubular housing A of suitable synthetic resinous material made up of two halves 1*a*, 1*b* which are joined by a web 2 defining a hinge zone extending longitudinally along the length of the housing. The two housing halves 1*a*, 1*b* are movable about the hinge zone 2 between an open position as shown in FIGS. 1, 2 and 5 and a closed position as shown in FIGS. 3 and 4. Releasably interengageable catch elements 3*a*, 3*b* are provided on the two housing halves 1*a*, 1*b* respectively to permit the halves to be securely locked together in their closed position.

Each catch element 3*a* comprises a resilient, plate-like element with an aperture 3*c* therethrough in which the associated tapered catch element 3*b* is releasably engageable so as releasably to lock the housing halves 1*a*, 1*b* together in their closed position. Due to their resilience, catch elements 3*a* are displaceable radially outwardly to permit them to be disengaged from catch elements 3*b* and allow housing halves 1*a*, 1*b* to be opened.

Housing A is open at its upper end 4 and is provided with a reduced neck zone 5 and a bead or flange 6 at the upper end of neck zone 5. An external screw thread 7 is provided on neck zone 5 below bead or flange 6 and is adapted to be engaged by an internal thread 8 on a locking ring 9 (FIG. 4).

Housing A is provided with a transverse floor 10 at its lower end. Co-operating clamp formations 11*a*, 11*b* of tongue and groove form are fast with the floor sections 10*a*, 10*b* of the two housing halves 1*a*, 1*b* respectively and present mating screw-threaded surfaces of complementary semi-circular cross-sectional configuration. Clamp formations 11*a*, 11*b* extend axially inwardly from floor 10 so that there are no external projections in the base zone of housing A. The clamp formation 11*a* which is of tongue form is in the nature of an upstanding, externally threaded tube which is integrally formed with the floor section 10*a* of housing half 1*a*. The clamp formation 11*b* which is of groove form is in the nature of an upstanding, internally threaded half tube which is integrally formed with the floor section 10*b* of housing half 1*b*. Clamp formations 11*a*, 11*b* constitute clamping means which is inoperative when the housing halves are in their open position and is operative to anchor the base region of a disposable liquid container when the housing halves are in their closed position, as will be described in greater detail below.

The floor 10 of housing A includes an external aperture 13 which is located in registration with the bore of the tubular clamp formation 11*a* of housing half 1*a*, thereby to present a socket 14 for the releasable accommodation of a hollow spigot or spindle 15 on the cap 16 shown in FIGS. 3 and 4, as will be described in greater detail below.

Tubular housing A is adapted to accommodate a disposable, open-ended, flexible bag-like container 12 (FIGS. 4 and 5) for liquid. Container 12 may be made from suitable flexible material and may be provided in the form of a tube or sock which is flattened when not in use and is expandable to tubular shape when filled. Container 12 has an open mouth zone 12*a*, a closed bag 12*b* and a base formation 12*c* in the form of a tongue depending from the body of container 12. Base formation 12*c* is adapted to be nipped between clamp formations 11*a*, 11*b* with container base 12*b* located on the upper ends of clamp formations 11*a*, 11*b* while the mouth zone 12*a* of container 12 is adapted to be folded over the upper end 4 of housing A, when the housing halves are in their closed position.

To load a container 12 in position, tube A is opened about the hinge zone 2 to assume the position shown in FIGS. 1 and 5. The container 12 is placed in the selected half 1*a* or 1*b* of housing A with the base 12*b* of the container body located at the upper end of, and the base formation 12*c* of the container located adjacent to the clamp formation 11*a* or 11*b* of the selected housing half, (such as illustrated in FIG. 5) and with the mouth zone 12*a* of container 12 extending through the open upper end of the housing half in question. By moving the two halves of housing A into the closed position shown in FIGS. 3 and 4, the base formation 12*c* of the container 12 is nipped between the mating screw-threaded surfaces of clamp formations 11*a*, 11*b* with the mouth zone 12*a* of the container extending through the open upper end 4 of housing A, thereby to anchor the base of container 12 and hence fix the extent of the mouth zone 12*a* of the container which extends through the open upper end 4 of housing A and which is available for folding over the upper end 4 of housing A. Correct and constant location of disposable flexible containers in housing A may thus be achieved with a substantially constant length of container depending below the upper end 4 of housing A to permit reliable scaling of the contents of a container.

The mouth zone 12*a* of the anchored container 12 may be folded over the bead or flange 6 of neck portion 5 of housing A in readiness for the container to be filled with milk or the like. After the filling of container 12, a teat 13 with a transverse flange formation 13*a* thereon, may be located over the open upper end of housing A to sandwich the mouth 12*a* of the container between the flange formation 13*a* of teat 13 and the upper face of bead or flange 6 on neck 5 of housing A, as shown in FIG. 4. Internally threaded sealing or locking ring 9 may then be placed in position over teat 13 and screwed onto thread 7 on the neck zone 5 of housing A so as firmly and sealingly to clamp the mouth 12*a* of container 12 against bead or flange 6 on the neck zone 5 of housing A and form a feeding bottle unit comprising housing A, container 12 and teat 13.

It is also possible for the mouth zone 12*a* of container 12 to be trapped between the engaging threads 7 and 8 of the neck portion 5 of housing A and of locking ring 9 respectively.

It will be appreciated that tubular housing A constitutes a holder adapted to mount flexible container 12 in its interior and also to mount teat 13 at its upper end to form the feeding bottle unit.

Longitudinally extending, elongate slots 17 are provided through the peripheral wall of housing A to allow for free passage of air between the interior and exterior of housing A so that flexible container 12 may collapse as liquid is dispensed therefrom and also to provide a view of the interior of the housing A and of the contents of container 12 in housing A. A suitably graduated contents scale similar to scale 118 which is provided along slots 117 in the embodiment of FIG. 6, may be provided along slots 17 on the outside of the peripheral wall of housing A. The contents scale should be suitably located relative to the upper ends of clamp formations 11*a*, 11*b* so that when the base region of container 12 is correctly located and anchored by the clamping means as described above, the fold of the mouth 12*a* of container 12 over the upper end of housing A is correctly fixed to permit reliable scaling of the contents of container 12. The graduations of the contents scale may be suitably numbered.

The interior of the cap 16 of FIGS. 3 and 4 is hollow and sufficiently conforms to the external shape and dimensions of locking ring 9 and teat 13 to permit cap 16 to be removably clipped onto locking ring 9 with teat 13 accommodated in the hollow interior of cap 16 for reasons of hygiene and/or for sealing teat 13 against leakage. Cap 16 may be removed from locking ring 9 for filling and/or use of the bottle. The spigot 15 on cap 16 may be plugged into the socket 14 in the base of housing A as shown in FIG. 3. In this position cap 16 may act as a support platform for housing A or may simply be mounted removably on housing A to minimize the danger of cap 16 being lost or mislaid when it is not in position on the upper end of housing A.

Instead of providing the externally screw threaded neck portion 5 of the embodiment of FIGS. 1 to 5 which is adapted to be associated with an internally threaded locking ring 9 adapted to secure a teat 13 with a flange formation 13*a*, any other suitable neck and/or teat arrangement may be provided, such as that dislosed in U.S. Pat. Nos. 3 075 666 or 3 790 017.

Figure 6:
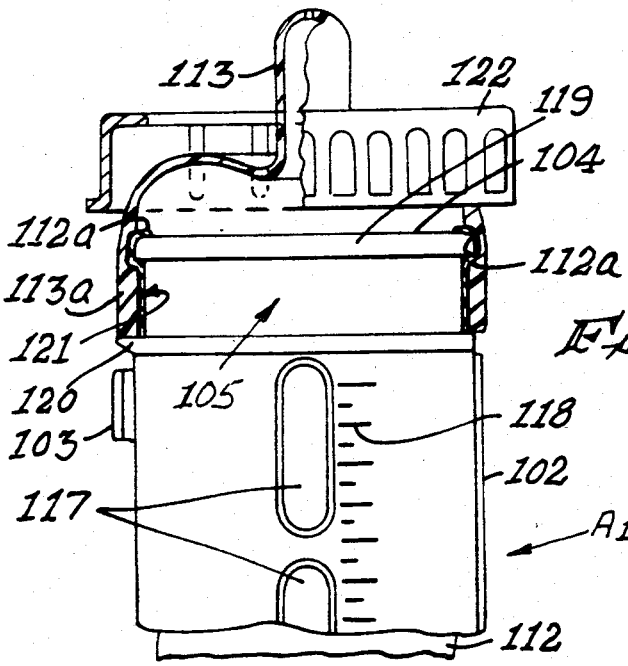
FIG. 6 is a fragmentary elevational view of the upper region of another embodiment of a tubular housing according to the invention, showing the mouth of a flexible bag and a teat in operative position and a locking ring for a teat in exploded position.
Figure 7:
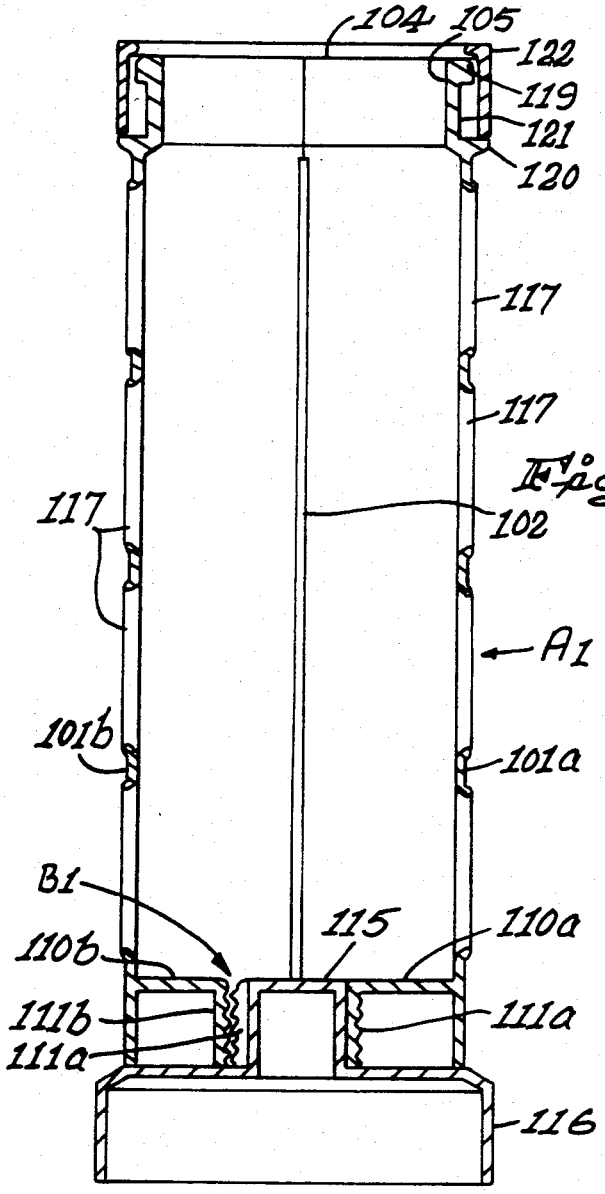
FIG. 7 is an elevational view of the entire tubular housing of FIG. 6 in a direction at right angles to that of FIG. 6, illustrating another form of complementary tongue and groove clamp formations.

In the embodiment illustrated in FIGS. 6 and 7, the upper zone 105 of housing A1 is formed with axially spaced upper and lower annular flanges 119 and 120 respectively defining an annular groove 121 therebetween. The mouth zone 112*a* of a flexible container 112 which is located in housing A1 may be folded over the upper flange 119 and onto the peripheral surface of groove 121 and then held securely in position by means of a resiliently flexible teat structure 113 similar to that disclosed in U.S. Pat. No. 3 790 017, which has a depending skirt 113*a* adapted to snap over the upper zone 105 of housing A1 with the mouth 112*a* of the container sandwiched between the teat skirt 113*a* on the one hand and the upper flange 119 and the peripheral surface of groove 121 on the other hand.

When the container has been filled, there may be an extra pressure developed by the liquid within the container sufficient to force open the teat arrangement at some point around the periphery of the upper zone 105. To prevent this happening or the possibility of the teat being displaced from its position on the upper end of housing A1, a locking ring 122 may be providing to clamp over the upper zone 105 with the depending skirt of the teat nipped within its bore.

Instead of the clamping formations 11*a*, 11*b* of FIGS. 1, 4 and 5 which extend inwardly from a floor 10 located at the lower end of housing A, the clamping means B1 of FIG. 7 may be provided. In this arrangement, floor 110 comprising sections 110A and 110B as shown in FIG. 7 is spaced upwardly from the lower end of the peripheral wall of housing A1 and downwardly directed tubular clamp formations 111*a*, 111*b* of tongue and groove form similar to formations 11*a*, 11*b* of FIGS. 1, 4 and 5, are integrally formed with the floor sections 110*a*, 110*b* respectively of the housing halves 101*a*, 101*b* respectively to extend axially outwardly from floor 110. With this arrangement the base of a container (not shown) in housing A1 may be located on floor 110 for correct anchoring of the container to fix the extent of the mouth zone of the container which is available for folding over the upper end of the housing.

A hollow cap 116 similar to cap 16 of FIGS. 3 and 4, may be provided for housing A1. Cap 116 may be clipped over locking ring 122 to enclose and/or seal a teat on the upper end of housing A1 or may be fitted to the base of housing A1 by plugging its spigot 115 into the socket defined by the bore of the tubular, tongue-like clamp formation 111*a* of the housing half 101*a*.

As shown in FIG. 6, housing A1 is provided with longitudinally extending, elongate slots 117 through the peripheral wall of housing A1 and a graduated contents scale 118 (which may be suitably numbered) is provided along slots 117 on the outside of the peripheral wall of housing A1.

Co-operating clamp formations of tongue and groove form of any suitable complementary configuration other than the semi-circular, screw threaded arrangement of FIGS. 1 to 7 may be provided. Instead of providing clamp formations which extend axially inwardly or outwardly from a floor at or near the lower end of a tubular housing, the floor may be of sufficient thickness for complementary tongue and groove clamp formations which do not project axially from the floor, to be provided in and/or on the floor sections of the housing halves.

Instead of clamp formations as illustrated in FIGS. 1 to 7 which are of tongue and groove form with mating screw threaded surfaces between which the base region of a flexible bag-like container may be nipped, any other suitable clamping means may be provided. Thus, clamp formations presenting mating surfaces extending substantially diametrically across the housing halves may be provided.

Referring to FIGS. 8 and 9, the two halves 201*a*, 201*b* of tubular housing A2 are formed with plate-like divisions 232*a*, 223*b* respectively which extend across the halves at low level in the housing. Divisions 223*a* and 223*b* are spaced upwardly from floor 210 comprising sections 210A and 210B as shown in FIG. 8, and define cavities 224*a* and 224*b* respectively in the halves 201*a*, 201*b* respectively of housing A2.

Divisions 223*a*, 223*b* present plane mating clamping surfaces 225*a*, 225*b* respectively which extend diametrically across the housing halves 201*a*, 201*b* and between which a base region of a flexible bag-like container (not shown) may be nipped. The base region of the container may extend into the cavities 224*a* and 224*b*.

Mating surfaces 225*a* and 225*b* may be serrated instead of being plane.

Referring now to FIGS. 10 and 11, the two halves 301*a*, 301*b* of housing A3 nay be provided with solid base portions 310*a*, 310*b* respectively which define serrated mating clamp surfaces 325*a*, 325*b* respectively which extend diametrically across housing halves 301*a*, 301*b* and between which a base region of a flexible bag-like container may be nipped. The two sets of serrations are complementary to one another with the protrusions of one set mating with the recesses of the other set.

It is possible for the mating clamp surfaces 325*a*, 325*b* of FIG. 10 and 11 to be plane instead of being serrated.

The base of a flexible container may be located on the divisions 223*a*, 223*b* of the housing A2 of FIGS. 8 and 9 or on the base portions 310*a*, 301*b* of the housing A3 of FIGS. 10 and 11 for correct anchoring of the container to fix the extent of the mouth zone of the container which is available for folding over the upper end of the housing.

It will be appreciated that many other variations in detail are possible without departing from the scope of the appended claims. For example, instead of providing three sets of interengageable catch elements 3*a*, 3*b* along the length of housing A as shown in FIGS. 1 and 3, only one or two suitably located sets of catch elements may be provided.

Any suitable flexible bag-type containers may be used with a housing according to the invention. Containers as disclosed in my South African patent application No. 81/3770 now U.S. Pat. No. 82/3696 granted on Mar. 30, 1983 are particularly suitable for use with a housing with complementary tongue and groove clamp formations of the kind described above with reference to FIGS. 1 to 7 of the drawings.

A housing according to the invention may be made of any suitable synthetic resinous material, such as polypropylene or a co-polymer thereof.

The material of the housing may be luminescent so that the housing is luminous at night.

I claim:

1. A feeding bottle housing of tubular configuration with an open upper end adapted to receive a teat and which is adapted to accommodate an open-ended flexible container in the interior of the housing with a mouth zone of the container folded over the upper end of the housing, the housing comprising two longitudinally divided sections which are linked together along a longitudinally extending hinge zone and are movable about the hinge zone between open and closed positions and clamping means located on a lower portion of the housing to anchor the base of a flexible container and fix the extent of the mouth zone of the container available for folding over the upper end of the housing, the clamping means comprising cooperating and elongated tongue and groove formations integral with the two housing sections, the formations presenting clamping surfaces of complementary curved cross-sectional configuration which are movable relative to each other in a direction transverse to the formations and about the longitudinally extending hinge zone between a separated, inoperative position when the two housing sections are in an open position and an operative position in which they mate to engage between them a base portion of the container when the two housing sections are in a closed position, the tongue formation also defining at least part of a socket adapted releasably to receive a projecting spigot formation on a removable teat cap.

2. A feeding bottle housing as claimed in claim 1, wherein in the clamping surfaces of the formations are screw threaded, the threads being movable into and out of complementary mating relationship in a direction transverse to the formations.

3. A feed bottle housing as claimed in claim 1, wherein the mating surfaces include gripping formations.

4. A feeding bottle housing of tubular configuration with an open upper end adapted to receive a teat and which is adapted to accommodate an open-ended flexible container in the interior of the housing with a mouth zone of the container folded over the upper end of the housing, the housing comprising two longitudinally divided sections which are linked together along a longitudinally extending hinge zone and are movable about the hinge zone between open and closed positions, each section having a transverse floor section forming a floor in the lower portion of the interior of the housing when the longitudinal sections are in closed position and longitudinally disposed first and second clamp formations located on the floor sections of the two housing sections, the first clamp formation being in the form of a half tube having an internal peripheral region presenting a concave clamp surface and the second clamp formation being in the form of a tube having an external peripheral region defining a convex clamp surface complementary with the concave clamp surface and having a hollow interior bore defining a socket adapted releasably to receive a spigot formation on a removable teat cap, the convex and concave clamp surfaces being movable relative to each other about the longitudinally extending hinge zone between a separated inoperative condition when the two housing sections are in open position and a mating operative condition in which they are adapted to engage between them and anchor a base region of the container when the two housing sections are in their closed position.

5. A feeding bottle housing as claimed in claim 4, wherein first and second clamp formations present screw-threaded clamp surfaces of curved cross-sectional configuration, the threads being movable into and out of complementary mating relationship.

6. A feeding bottle housing as claimed in claim 4, wherein the mating surfaces include gripping formations.

7. A feeding bottle housing as claimed in any one of claims 1 to 6, containing a graduated contents scale along a wall of one of said housing sections and located between the upper end of said housing and the clamp formations to permit scaling of the contents of a container anchored in the housing.

8. A feeding bottle housing of tubular configuration with an open upper end adapted to receive a teat and which is adapted to accommodate an open-ended flexible container in the interior of the housing with a mouth zone of the container folded over the upper end of the housing, the housing comprising two longitudinally divided sections which are linked together along a longitudinally extending hinge zone and are movable about the hinge zone between open and closed positions and clamping means located on a lower portion of the housing to anchor the base of a flexible container and fix the extent of the mouth zone of the container available for folding over the upper end of the housing, the clamping means comprising cooperating tongue and groove formations located on the two housing sections, the tongue formation defining at least part of a socket adapted releasably to receive a projecting spigot formation on a removable teat cap, the clamp formations extending longitudinally relative to the housing and being movable relative to each other about the longitudinally extending hinge zone between an inoperative position when the two housing sections are in open position and an operative position, where they engage between them a base portion of the flexible container, when the two housing sections are in closed position.

* * * * *